US008703681B2

(12) United States Patent
Page et al.

(10) Patent No.: US 8,703,681 B2
(45) **Date of Patent: *Apr. 22, 2014**

(54) LUBRICATION OIL COMPOSITIONS

(75) Inventors: Matthew Arthur Page, Wilmington, DE (US); Hari Babu Sunkara, Hockessin, DE (US); Kanthi S. Wijesekera, Garnet Valley, PA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/974,307

(22) Filed: Dec. 21, 2010

(65) Prior Publication Data

US 2012/0004152 A1 Jan. 5, 2012

Related U.S. Application Data

(63) Continuation-in-part of application No. 12/195,697, filed on Aug. 21, 2008, now abandoned.

(60) Provisional application No. 60/957,725, filed on Aug. 24, 2007.

(51) Int. Cl.
*C10M 111/04* (2006.01)

(52) U.S. Cl.
USPC ..... 508/532; 508/579

(58) Field of Classification Search
USPC ..... 508/501, 532, 579
See application file for complete search history.

(56) References Cited

U.S. PATENT DOCUMENTS

| | | | | |
|---|---|---|---|---|
| 2,520,733 | A * | 8/1950 | Snider et al. | 568/619 |
| 2,520,773 | A | 8/1950 | Morris et al. | |
| 2,599,803 | A | 6/1952 | Ballard et al. | |
| 4,702,850 | A | 10/1987 | Gutierrez et al. | |
| 4,867,890 | A | 9/1989 | Coclough et al. | |
| 5,015,789 | A | 5/1991 | Arntz et al. | |
| 5,276,201 | A | 1/1994 | Haas et al. | |
| 5,284,979 | A | 2/1994 | Haas et al. | |
| 5,334,778 | A | 8/1994 | Haas et al. | |
| 5,364,984 | A | 11/1994 | Arntz et al. | |
| 5,364,987 | A | 11/1994 | Arntz et al. | |
| 5,633,362 | A | 5/1997 | Nagarajan et al. | |
| 5,686,276 | A | 11/1997 | Laffend et al. | |
| 5,821,092 | A | 10/1998 | Nagarajan et al. | |
| 5,962,745 | A | 10/1999 | Brossmer et al. | |
| 6,140,543 | A | 10/2000 | Brossmer et al. | |
| 6,232,511 | B1 | 5/2001 | Haas et al. | |
| 6,235,948 | B1 | 5/2001 | Sunkara et al. | |
| 6,277,289 | B1 | 8/2001 | Kurian et al. | |
| 6,297,408 | B1 | 10/2001 | Haas et al. | |
| 6,331,264 | B1 | 12/2001 | Kurian et al. | |
| 6,342,646 | B1 | 1/2002 | Haas et al. | |
| 6,583,302 | B1 | 6/2003 | Erhan et al. | |
| 6,720,459 | B2 | 4/2004 | Sunkara et al. | |
| 6,977,291 | B2 | 12/2005 | Sunkara et al. | |
| 7,009,082 | B2 | 3/2006 | Sunkara et al. | |
| 7,038,092 | B2 | 5/2006 | Sunkara et al. | |
| 7,074,969 | B2 | 7/2006 | Sunkara et al. | |
| 7,084,311 | B2 | 8/2006 | Sunkara et al. | |
| 7,098,368 | B2 | 8/2006 | Seapan et al. | |
| 7,157,607 | B1 | 1/2007 | Sunkara et al. | |
| 7,161,045 | B1 | 1/2007 | Sunkara et al. | |
| 7,164,046 | B1 | 1/2007 | Sunkara et al. | |
| 7,282,159 | B2 | 10/2007 | Sunkara | |
| 7,413,677 | B2 | 8/2008 | Sunkara | |
| 2004/0030095 | A1 | 2/2004 | Sunkara et al. | |
| 2005/0020805 | A1 | 1/2005 | Sunkara et al. | |
| 2005/0069997 | A1 | 3/2005 | Akesson et al. | |
| 2005/0277792 | A1 * | 12/2005 | Seapan et al. | 568/679 |
| 2008/0108845 | A1 | 5/2008 | Sunkara et al. | |
| 2009/0054282 | A1 | 2/2009 | Sunkara | |

FOREIGN PATENT DOCUMENTS

| | | |
|---|---|---|
| EP | 0330522 B1 | 8/1989 |
| GB | 1560830 | 2/1980 |
| JP | 2004-182974 | 7/2004 |
| JP | 2004182974 | 7/2004 |
| WO | 2008057462 A | 5/2008 |

OTHER PUBLICATIONS

International Search Report, PCT International Application PCT/US2008/073832, Dec. 4, 2008.
International Search Report, PCT International Application PCT/US2008/73815, Dec. 4, 2008.
Buffle, Source Apportionment of Atmospheric Particles, IUPAC Environmental Analytical Chemistry Series, vol. 1 (1992), pp. 3-74.
Hsieh, Division S-3 Soil Microbiology & Biochemistry, Soil Sci. Soc. Am. J., vol. 56 (1992), pp. 460-464.
Weber et al., C-Pattern of Natural Glycerol.: Origin and Practical Importance, J. Agric. Food Chem., vol. 45 (1997), pp. 2042-2046.
International Search Report, PCT International Application PCT/US2008/73815, Mailed Dec. 4, 2008.
U.S. Appl. No. 11/593,954, filed Nov. 7, 2006, Applicant: Hari Babu Sunkara et al.
Buffle, Source Apportionment of Atmospheric Particles, IUPAC Environmental Analytical Chemistry Series, 1992, vol. 1:3-74.
Y. Hsieh, Division S-3-Soil Microbiology & Biochemistry, Soil Sci. Soc. Am. J., 1992, vol. 56:460-464.
Weber et al., C-Pattern of Natural Glycerol: Origin and Practical Importance, J. Agric. Food Chem., 1997, vol. 45:2042-2046.

* cited by examiner

*Primary Examiner* — Taiwo Oladapo

(57) ABSTRACT

Provided are lubrication oil compositions. The compositions contain certain acid esters (monoesters and/or diesters) of polytrimethylene ether glycol, certain additives, and optionally a polytrimethylene ether glycol, and the use of such compositions as lubrication oils.

16 Claims, No Drawings

LUBRICATION OIL COMPOSITIONS

CROSS-REFERENCE TO RELATED APPLICATIONS

This application is a continuation-in-part of U.S. application Ser. No. 12/195,697 and related to commonly owned U.S. application Ser. No. 11/593,954, filed Nov. 7, 2006; commonly owned U.S. application Ser. No. 12/195,685 filed Nov. 24, 2007; commonly owned U.S. application Ser. No. 12/195,681, filed Nov. 24, 2007; and commonly owned U.S. application Ser. No. 12/195,710, filed Nov. 24, 2007. This application claims priority to U.S. Provisional Application Ser. No. 60/957,725, filed Nov. 24, 2007.

FIELD OF THE INVENTION

This invention relates compositions comprising (i) acid esters (monoesters and/or diesters) of polytrimethylene ether glycol (PO3G esters), (ii) additives, and optionally (iii) a polytrimethylene ether glycol (PO3G), and the use of such compositions as lubrication oils.

BACKGROUND

Certain mono- and diesters of polytrimethylene ether glycol ("PO3G esters") have properties that make them useful in a variety of fields, including as lubricants, as disclosed in commonly owned U.S. application Ser. No. 11/593,954.

Specific properties are desired in lubrication oils, such as viscosity suitable for a specific application, low pour point, high load carry capacity, low wear properties, and high extreme pressure (EP) protection along with good coefficient of friction. Neither PO3G ester nor PO3G neat fluids have most of the desired properties. For example, PO3G esters have very good fluid properties such as low viscosity and pour point but poor wear and extreme pressure protection, whereas PO3G polymers exhibit poor fluid properties (high viscosity and pour point) as a result of crystalline nature. Therefore, there is a need to tailor the properties of the final lubrication oils comprising these fluids.

The present invention is directed to specific lubricant compositions based on such PO3G esters.

SUMMARY OF THE INVENTION

One aspect of the present invention is a lubrication oil composition comprising (i) a base fluid stock comprising an acid ester of a polytrimethylene ether glycol that is a fluid at ambient temperature; and (ii) one or more lube oil additives, wherein the polytrimethylene ether glycol is prepared by the polycondensation of monomers comprising 1,3-propanediol in the presence of a sulfur-based acid catalyst.

DETAILED DESCRIPTION

The present invention relates to the use of PO3G esters, or mixtures of one or more PO3Gs and one or more PO3G esters, along with one or more additives, as lubrication oils.

In some embodiments, the PO3G and PO3G ester are derived from biologically produced 1,3-propanediol. In such embodiments, lubricant compositions having renewable carbon content can be provided.

Unless otherwise defined, all technical and scientific terms used herein have the same meaning as commonly understood by one of ordinary skill in the art to which this invention belongs. In case of conflict, the present specification, including definitions, will control.

Except where expressly noted, trademarks are shown in upper case.

Unless stated otherwise, all percentages, parts, ratios, etc., are by weight.

When an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

When the term "about" is used in describing a value or an end-point of a range, the value or range is intended to include the specific value or end-point referred to.

Use of "a" or "an" is intended to include one or at least one, and the singular also includes the plural unless it is stated or apparent from context that it is meant otherwise.

The materials, methods, and examples herein are illustrative only and, except as specifically stated, are not intended to be limiting.

Base Fluid Stock

The base fluid stock for use in the lubrication oil compositions comprises a PO3G (polytrimethylene ether glycol) ester, optionally mixed with PO3G, that is a fluid at ambient temperature (25° C.). The base fluid stock can also contain other natural and/or synthetic fluid co-lubricants.

Examples of natural fluid co-lubricants include vegetable oil-based lubricants, which are generally derived from plants and are generally composed of triglycerides. Normally, these are liquid at room temperature. Although many different parts of plants can yield oil, in actual practice oil is generally extracted primarily from the seeds of oilseed plants. Such oils include both edible and inedible oils, and include, for example, high oleic sunflower oil, rapeseed oil, soybean oil, castor oil and the like, as well as modified oils such as disclosed in U.S. Pat. No. 6,583,302 (fatty acid esters) and I. Malchev, "Plant-Oil-Based Lubricants" (available from the Department of Plant Agriculture, Ontario Agriculture College, University of Guelph, 50 Stone Road W., Guelph, Ontario, Canada N1G 2W1).

Synthetic fluid co-lubricants (other than the PO3G and PO3G esters) include lubricating oils such as hydrocarbon oils such as polybutylenes, polypropylenes, propylene-isobutylene copolymers; polyoxyalkylene glycol polymers (other than PO3G) and their derivatives such as ethylene oxide and propylene oxide copolymers; and esters of dicarboxylic acids with a variety of alcohols such as dibutyl adipate, di(2-ethylhexyl)sebacate, di-hexyl fumarate, dioctyl sebacate, diisoctyl azelate, diisodecyl azelate, dioctyl phthalate, didecyl phthalate, and the 2-ethylhexyl diester of linoleic acid dimer.

Preferably, the base stock comprises a predominant amount of the PO3G ester. The term "predominant amount", as used herein, means greater than 50 percent. With respect to the amount of PO3G ester in the base stock, the amount of PO3G ester is based on the weight of the base stock, i.e., greater than 50 weight percent based on the total weight of the base stock. In some embodiments, the base stock can comprise the PO3G ester in an amount of about 66 weight percent or greater, or about 75 weight percent or greater, or about 90 weight percent or greater, or about 95 weight percent or greater, based on the total weight of the base fluid stock. In other embodiments, the base fluid stock contains only, or substantially only, the PO3G ester.

In another embodiment, the base stock preferably comprises a predominant amount of PO3G/PO3G ester mixture (greater than 50 weight percent based on the weight of the base stock). In some embodiments, the base stock can comprise the PO3G/PO3G ester mixture in an amount of about 66 weight percent or greater, or about 75 weight percent or greater, or about 90 weight percent or greater, or about 95 weight percent or greater, based on the total weight of the base fluid stock. In some preferred embodiments, the base fluid stock comprises only, or substantially only, the PO3G/PO3G ester mixture.

In one embodiment, the weight ratio of PO3G/PO3G ester in the base fluid stock is greater than 1:1 (the PO3G being the predominant component), or about 1.5:1 or greater, or about 2:1 or greater, or about 5:1 or greater, or about 20:1 or greater. Also, the weight ratio is preferably about 25:1 or less, or about 20:1 or less, or about 10:1 or less.

In another embodiment, the weight ratio of PO3G ester/PO3G in the base fluid stock is greater than 1:1 (the PO3G ester being the predominant component), or about 1.5:1 or greater, or about 2:1 or greater, or about 5:1 or greater, or about 20:1 or greater. Also, the weight ratio is preferably about 25:1 or less, or about 20:1 or less, or about 10:1 or less.

In yet another embodiment, the weight ratio of PO3G/PO3G ester in the base fluid stock is about 1:1 (approximately equivalent weight amounts of the two components).

The lubrication oil composition preferably comprises the base oil stock in an amount of about 50 weight percent or greater, based on the total weight of the lubrication oil composition. In various embodiments, the lubrication oil can comprise the base stock in an amount of about 75 weight percent or greater, or about 90 weight percent or greater, or about 95 weight percent or greater, based on the total weight of the lubrication oil composition.

Mono- and Diesters of Polytrimethylene Ether Glycol

In some embodiments, the PO3G esters comprise one or more compounds of the formula (I):

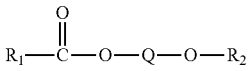

(I)

wherein Q represents the residue of a polytrimethylene ether glycol after abstraction of the hydroxyl groups, $R_2$ is H or $R_3CO$, and each of $R_1$ and $R_3$ is individually a substituted or unsubstituted aromatic, saturated aliphatic, unsaturated aliphatic or cycloaliphatic organic group, containing 4 to 40 carbon atoms, preferably at least 6 carbon atoms, more preferably at least 8 carbon atoms. In some embodiments each of $R_1$ and $R_3$ has 20 carbon atoms or fewer, and in some embodiments 10 carbon atoms or fewer. In some preferred embodiments, each of $R_1$ and $R_3$ has 8 carbon atoms.

PO3G esters are preferably prepared by polycondensation of hydroxyl groupscontaining monomers (monomers containing 2 or more hydroxyl groups) predominantly comprising 1,3-propanediol to form a PO3G (as disclosed in further detail below), followed by esterification with a monocarboxylic acid (or equivalent), as disclosed in U.S. application Ser. No. 11/593,954.

The PO3G ester thus prepared is a composition preferably comprising from about 50 to 100 weight percent, more preferably from about 75 to 100 weight percent, diester and from 0 to about 50 weight percent, more preferably from 0 to about 25 weight percent, monoester, based on the total weight of the esters. Preferably the mono- and diesters are esters of 2-ethylhexanoic acid.

The PO3G used for preparing the ester can be the same as or different from the PO3G co-component of the base fluid stock.

Polytrimethylene Ether Glycol (PO3G)

PO3G as used in the context of the compositions and processes disclosed herein is an oligomeric or polymeric ether glycol in which at least 50% of the repeating units are trimethylene ether units. More preferably from about 75% to 100%, still more preferably from about 90% to 100%, and even more preferably from about 99% to 100%, of the repeating units are trimethylene ether units.

PO3G is preferably prepared by polycondensation of monomers comprising 1,3-propanediol, preferably in the presence of an acid catalyst, thus resulting in polymers or copolymers containing —($CH_2CH_2CH_2O$)— linkage (e.g, trimethylene ether repeating units). As indicated above, at least 50% of the repeating units are trimethylene ether units.

When a sulfur-based acid catalyst is utilized (such as sulfuric acid) to prepare the PO3G, the resulting product preferably contains less than about 20 ppm, more preferably less than about 10 ppm, of sulfur.

In addition to the trimethylene ether units, lesser amounts of other units, such as other polyalkylene ether repeating units, can be present. In the context of this disclosure, the term "polytrimethylene ether glycol" encompasses PO3G made from essentially pure 1,3-propanediol, as well as those oligomers and polymers (including those described below) containing up to about 50% by weight of comonomers.

The 1,3-propanediol employed for preparing the PO3G can be obtained by any of the various well known chemical routes or by biochemical transformation routes. Preferred routes are described in, for example, U.S. Pat. Nos. 5,015,789, 5,276,201, 5,284,979, 5,334,778, 5,364,984, 5,364,987, 5,633,362, 5,686,276, 5,821,092 5,962,745, 6,140,543, 6,232,511, 6,235,948, 6,277,289, 6,297,408 6,331,264, 6,342,646, 7,038,092, 7,084,311, 7,098,368, 7,009,082 and US20050069997A1.

Preferably, the 1,3-propanediol is obtained biochemically from a renewable source ("biologically-derived" 1,3-propanediol).

A particularly preferred source of 1,3-propanediol is via a fermentation process using a renewable biological source. As an illustrative example of a starting material from a renewable source, biochemical routes to 1,3-propanediol (PDO) have been described that utilize feedstocks produced from biological and renewable resources such as corn feed stock. For example, bacterial strains able to convert glycerol into 1,3-propanediol are found in the species *Klebsiella, Citrobacter, Clostridium*, and *Lactobacillus*. The technique is disclosed in several publications, including U.S. Pat. No. 5,633,362, U.S. Pat. Nos. 5,686,276 and 5,821,092. 5,821,092 discloses, inter alia, a process for the biological production of 1,3-propanediol from glycerol using recombinant organisms. The process incorporates *E. coli* bacteria, transformed with a heterologous pdu diol dehydratase gene, having specificity for 1,2-propanediol. The transformed *E. coli* is grown in the presence of glycerol as a carbon source and 1,3-propanediol is isolated from the growth media. Since both bacteria and yeasts can convert glucose (e.g., corn sugar) or other carbohydrates to glycerol, the processes disclosed in these publications provide a rapid, inexpensive and environmentally responsible source of 1,3-propanediol monomer.

The biologically-derived 1,3-propanediol, such as produced by the processes described and referenced above, contains carbon from the atmospheric carbon dioxide incorporated by plants, which compose the feedstock for the production of the 1,3-propanediol. In some preferred embodiments, the biologically-derived 1,3-propanediol contains only renewable carbon, and not fossil fuel-based or petroleum-based carbon. The PO3G and esters thereon utilizing the biologically-derived 1,3-propanediol, therefore, have less impact on the environment as the 1,3-propanediol used in the compositions does not deplete diminishing fossil fuels and, upon degradation, releases carbon back to the atmosphere for use by plants once again. Thus, in some embodiments, the compositions can be characterized as more natural and having less environmental impact than similar compositions comprising petroleum based glycols.

The biologically-derived 1,3-propanediol, PO3G and PO3G esters, can be distinguished from similar compounds produced from a petrochemical source or from fossil fuel carbon by dual carbon-isotopic finger printing. This method usefully distinguishes chemically-identical materials, and apportions carbon in the copolymer by source (and possibly year) of growth of the biospheric (plant) component. The isotopes, $^{14}C$ and $^{13}C$, bring complementary information to this problem. The radiocarbon dating isotope ($^{14}C$), with its nuclear half life of 5730 years, clearly allows one to apportion specimen carbon between fossil ("dead") and biospheric ("alive") feedstocks (Currie, L. A. "Source Apportionment of Atmospheric Particles," *Characterization of Environmental Particles*, J. Buffle and H. P. van Leeuwen, Eds., 1 of Vol. I of the IUPAC Environmental Analytical Chemistry Series (Lewis Publishers, Inc) (1992) 3-74). The basic assumption in radiocarbon dating is that the constancy of $^{14}C$ concentration in the atmosphere leads to the constancy of $^{14}C$ in living organisms. When dealing with an isolated sample, the age of a sample can be deduced approximately by the relationship:

$$t=(-5730/0.693)\ \ln\ (A/A_0)$$

wherein t=age, 5730 years is the half-life of radiocarbon, and A and $A_0$ are the specific $^{14}C$ activity of the sample and of the modern standard, respectively (Hsieh, Y., *Soil Sci. Soc. Am J.*, 56, 460, (1992)). However, because of atmospheric nuclear testing since 1950 and the burning of fossil fuel since 1850, $^{14}C$ has acquired a second, geochemical time characteristic. Its concentration in atmospheric $CO_2$, and hence in the living biosphere, approximately doubled at the peak of nuclear testing, in the mid-1960s. It has since been gradually returning to the steady-state cosmogenic (atmospheric) baseline isotope rate ($^{14}C/^{12}C$) of ca. $1.2\times10^{-12}$, with an approximate relaxation "half-life" of 7-10 years. (The latter half-life can be interpreted using the detailed atmospheric nuclear input/decay function to trace the variation of atmospheric and biospheric $^{14}C$ since the onset of the nuclear age.) It is this latter biospheric $^{14}C$ time characteristic that holds out the promise of annual dating of recent biospheric carbon. $^{14}C$ can be measured by accelerator mass spectrometry (AMS), with results given in units of "fraction of modern carbon" ($f_M$). $f_M$ is defined by National Institute of Standards and Technology (NIST) Standard Reference Materials (SRMs) 4990B and 4990C, known as oxalic acids standards HOxI and HOxII, respectively. The fundamental definition relates to 0.95 times the $^{14}C/^{12}C$ isotope ratio HOxI (referenced to AD 1950). This is roughly equivalent to decay-corrected pre-Industrial Revolution wood. For the current living biosphere (plant material), $f_M\approx1.1$.

The stable carbon isotope ratio ($^{13}C/^{12}C$) provides a complementary route to source discrimination and apportionment. The $^{13}C/^{12}C$ ratio in a given biosourced material is a consequence of the $^{13}C/^{12}C$ ratio in atmospheric carbon dioxide at the time the carbon dioxide is fixed and also reflects the precise metabolic pathway. Regional variations also occur. Petroleum, $C_3$ plants (the broadleaf), $C_4$ plants (the grasses), and marine carbonates all show significant differences in $^{13}C/^{12}C$ and the corresponding $\delta^{13}C$ values. Furthermore, lipid matter of $C_3$ and $C_4$ plants analyze differently than materials derived from the carbohydrate components of the same plants as a consequence of the metabolic pathway. Within the precision of measurement, $^{13}C$ shows large variations due to isotopic fractionation effects, the most significant of which is the photosynthetic mechanism. The major cause of differences in the carbon isotope ratio in plants is closely associated with differences in the pathway of photosynthetic carbon metabolism in the plants, particularly the reaction occurring during the primary carboxylation, i.e., the initial fixation of atmospheric $CO_2$. Two large classes of vegetation are those that incorporate the "$C_3$" (or Calvin-Benson) photosynthetic cycle and those that incorporate the "$C_4$" (or Hatch-Slack) photosynthetic cycle. $C_3$ plants, such as hardwoods and conifers, are dominant in the temperate climate zones. In $C_3$ plants, the primary $CO_2$ fixation or carboxylation reaction involves the enzyme ribulose-1,5-diphosphate carboxylase and the first stable product is a 3-carbon compound. $C_4$ plants, on the other hand, include such plants as tropical grasses, corn and sugar cane. In $C_4$ plants, an additional carboxylation reaction involving another enzyme, phosphenol-pyruvate carboxylase, is the primary carboxylation reaction. The first stable carbon compound is a 4-carbon acid, which is subsequently decarboxylated. The $CO_2$ thus released is refixed by the $C_3$ cycle.

Both $C_4$ and $C_3$ plants exhibit a range of $^{13}C/^{12}C$ isotopic ratios, but typical values are ca. −10 to −14 per mil ($C_4$) and −21 to −26 per mil ($C_3$) (Weber et al., *J. Agric. Food Chem.*, 45, 2942 (1997)). Coal and petroleum fall generally in this latter range. The $^{13}C$ measurement scale was originally defined by a zero set by pee dee belemnite (PDB) limestone, where values are given in parts per thousand deviations from this material. The "$\delta^{13}C$" values are in parts per thousand (per mil), abbreviated %, and are calculated as follows:

$$\delta^{13}C \equiv \frac{(^{13}C/^{12}C)\text{sample} - (^{13}C/^{12}C)\text{standard}}{(^{13}C/^{12}C)\text{standard}} \times 1000\%$$

Since the PDB reference material (RM) has been exhausted, a series of alternative RMs have been developed in cooperation with the IAEA, USGS, NIST, and other selected international isotope laboratories. Notations for the per mil deviations from PDB is $\delta^{13}C$. Measurements are made on $CO_2$ by high precision stable ratio mass spectrometry (IRMS) on molecular ions of masses 44, 45 and 46.

Biologically-derived 1,3-propanediol, and compositions comprising biologicallyderived 1,3-propanediol, therefore, can be distinguished from their petrochemical derived counterparts on the basis of $^{14}C$ ($f_M$) and dual carbon-isotopic fingerprinting, indicating new compositions of matter. The ability to distinguish these products is beneficial in tracking these materials in commerce. For example, products comprising both "new" and "old" carbon isotope profiles can be distinguished from products made only of "old" materials. Hence, such materials can be followed in commerce on the basis of their unique profile and for the purposes of defining competition, for determining shelf life, and especially for assessing environmental impact.

Preferably the 1,3-propanediol used as the reactant or as a component of the reactant will have a purity of greater than about 99%, and more preferably greater than about 99.9%, by weight as determined by gas chromatographic analysis. Particularly preferred are the purified 1,3-propanediols as disclosed in U.S. Pat. Nos. 7,038,092, 7,098,368, 7,084,311 and US20050069997A1, as well as PO3G made therefrom as disclosed in US20050020805A1.

The purified 1,3-propanediol preferably has the following characteristics:

(1) an ultraviolet absorption at 220 nm of less than about 0.200, and at 250 nm of less than about 0.075, and at 275 nm of less than about 0.075; and/or (2) a composition having L*a*b*"b*" color value of less than about 0.15 (ASTM D6290), and an absorbance at 270 nm of less than about 0.075; and/or (3) a peroxide composition of less than about 10 ppm; and/or (4) a concentration of total organic impurities (organic compounds other than 1,3-propanediol) of less than about 400 ppm, more preferably less than about 300 ppm, and still more preferably less than about 150 ppm, as measured by gas chromatography.

The starting material for making PO3G will depend on the desired PO3G, availability of starting materials, catalysts, equipment, etc., and comprises "1,3-propanediol reactant." By "1,3-propanediol reactant" is meant 1,3-propanediol, and oligomers and prepolymers of 1,3-propanediol preferably having a degree of polymerization of 2 to 9, and mixtures thereof. In some instances, it may be desirable to use up to 10% or more of low molecular weight oligomers where they are available. Thus, preferably the starting material comprises 1,3-propanediol and the dimer and trimer thereof. A particularly preferred starting material is comprised of about 90% by weight or more 1,3-propanediol, and more preferably 99% by weight or more 1,3-propanediol, based on the weight of the 1,3-propanediol reactant.

PO3G can be made via a number of processes known in the art, such as disclosed in U.S. Pat. Nos. 6,977,291 and 6,720,459. The preferred processes are as set forth in U.S. Pat. Nos. 7,074,969, 7,157,607, 7,161,045 and 7,164,046.

As indicated above, PO3G can contain lesser amounts of other polyalkylene ether repeating units in addition to the trimethylene ether units. The monomers for use in preparing polytrimethylene ether glycol can, therefore, contain up to 50% by weight (preferably about 20 weight percent or less, more preferably about 10 weight percent or less, and still more preferably about 2 weight percent or less), of comonomer polyols in addition to the 1,3-propanediol reactant. Comonomer polyols that are suitable for use in the process include aliphatic diols, for example, ethylene glycol, 1,6-hexanediol, 1,7-heptanediol, 1,8-octanediol, 1,9-nonanediol, 1,10-decanediol, 1,12-dodecanediol, 3,3,4,4,5,5-hexafluoro-1,5-pentanediol, 2,2,3,3,4,4,5,5-octafluoro-1,6-hexanediol, and 3,3,4,4,5,5,6,6,7,7,8,8,9,9,10,10-hexadecafluoro-1,12-dodecanediol; cycloaliphatic diols, for example, 1,4-cyclohexanediol, 1,4-cyclohexanedimethanol and isosorbide; and polyhydroxy compounds, for example, glycerol, trimethylolpropane, and pentaerythritol. A preferred group of comonomer diols is selected from the group consisting of ethylene glycol, 2-methyl-1,3-propanediol, 2,2-dimethyl-1,3-propanediol, 2,2-diethyl-1,3-propanediol, 2-ethyl-2-(hydroxymethyl)-1,3-propanediol, $C_6$-$C_{10}$ diols (such as 1,6-hexanediol, 1,8-octanediol and 1,10-decanediol) and isosorbide, and mixtures thereof. A particularly preferred diol other than 1,3-propanediol is ethylene glycol, and $C_6$-$C_{10}$ diols can be particularly useful as well.

One preferred PO3G containing comonomers is poly(trimethylene-ethylene ether) glycol such as described in US20040030095A1. Preferred poly(trimethyleneethylene ether) glycols are prepared by acid catalyzed polycondensation of from 50 to about 99 mole % (preferably from about 60 to about 98 mole %, and more preferably from about 70 to about 98 mole %) 1,3-propanediol and up to 50 to about 1 mole % (preferably from about 40 to about 2 mole %, and more preferably from about 30 to about 2 mole %) ethylene glycol.

Preferably, the PO3G after purification has essentially no acid catalyst end groups, but can contain very low levels of unsaturated end groups, predominately allyl end groups, in the range of from about 0.003 to about 0.03 meq/g. Such a PO3G can be considered to comprise or consist essentially of the compounds having the following formulae (II) and (III):

$$HO—((CH_2)_3O)_m—H \quad (II)$$

$$HO—((CH_2)_3—O)_mCH_2CH{=}CH_2 \quad (III)$$

wherein m is in a range such that the Mn (number average molecular weight) is within the range of from about 200 to about 10000, with compounds of formula (III) being present in an amount such that the allyl end groups (preferably all unsaturation ends or end groups) are present in the range of from about 0.003 to about 0.03 meq/g.

The preferred PO3G has an Mn (number average molecular weight) of at least about 250, more preferably at least about 500, more preferably at least about 1000, and still more preferably at least about 2000. The Mn is preferably less than about 10000, more preferably less than about 5000, more preferably less than about 3500, and still more preferably less than about 2500. Blends of PO3Gs can also be used. For example, the PO3G can comprise a blend of a higher and a lower molecular weight PO3G, preferably wherein the higher molecular weight PO3G has a number average molecular weight of from about 1000 to about 5000, and the lower molecular weight PO3G has a number average molecular weight of from about 200 to about 950. The Mn of the blended PO3G will preferably still be in the ranges mentioned above.

In preferred embodiments the PO3G is polydisperse, having a polydispersity (i.e. Mw/Mn) of preferably from about 1.1 to about 2.2, more preferably from about 1.2 to about 2.2, and still more preferably from about 1.5 to about 2.1. The polydispersity can be adjusted by using blends of PO3G.

Preferably the PO3G has a color value of less than about 200 APHA, and more preferably less than about 100 APHA, and a viscosity which is preferably greater than the viscosity of the PO3G ester. A preferred viscosity is about 100 cSt or greater at 40° C.

Acid and Acid Equivalents

The esterification of the PO3G is carried out by reaction with an acid and/or equivalent, preferably a monocarboxylic acid and/or equivalent.

By "monocarboxylic acid equivalent" is meant compounds that perform substantially like monocarboxylic acids in reaction with polymeric glycols and diols, as would be generally recognized by a person of ordinary skill in the relevant art. Monocarboxylic acid equivalents include, for example, esters of monocarboxylic acids, and ester-forming derivatives such as acid halides (e.g., acid chlorides) and anhydrides.

Preferably, a monocarboxylic acid is used having the formula R—COOH, wherein R is a substituted or unsubstituted aromatic, aliphatic or cycloaliphatic organic moiety containing from 6 to 40 carbon atoms.

Mixtures of different monocarboxylic acids and/or equivalents are also suitable.

As indicated above, the monocarboxylic acid (or equivalent) can be aromatic, aliphatic or cycloaliphatic. In this regard, "aromatic" monocarboxylic acids are monocarboxylic acids in which a carboxyl group is attached to a carbon atom in a benzene ring system such as those mentioned below. "Aliphatic" monocarboxylic acids are monocarboxylic acids in which a carboxyl group is attached to a fully saturated carbon atom or to a carbon atom which is part of an olefinic double bond. If the carbon atom is in a ring, the equivalent is "cycloaliphatic."

The monocarboxylic acid (or equivalent) can contain any substituent groups or combinations thereof (such as functional groups like amide, amine, carbonyl, halide, hydroxyl, etc.), so long as the substituent groups do not interfere with the esterification reaction or adversely affect the properties of the resulting ester product.

The monocarboxylic acids and equivalents can be from any source, but preferably are derived from natural sources or are bio-derived.

The following acids and their derivatives are specifically preferred: lauric, myristic, palmitic, stearic, arachidic, benzoic, caprylic, erucic, palmitoleic, pentadecanoic, heptadecanoic, nonadecanoic, linoleic, arachidonic, oleic, valeric, caproic, capric and 2-ethylhexanoic acids, and mixtures thereof. Particularly preferred acids or derivatives thereof are 2-ethylhexanoic acid, benzoic acid, stearic acid, lauric acid and oleic acid.

Esterification Process

For preparation of the esters, the PO3G can be contacted, preferably in the presence of an inert gas, with the monocarboxylic acid(s) at temperatures ranging from about 100° C. to about 275° C., preferably from about 125° C. to about 250° C. The process can be carried out at atmospheric pressure or under vacuum. During the contacting water is formed and can be removed in the inert gas stream or under vacuum to drive the reaction to completion.

To facilitate the reaction of PO3G with carboxylic acid an esterfication catalyst is generally used, preferably a mineral acid catalyst. Examples of mineral acid catalysts include but are not restricted to sulfuric acid, hydrochloric acid, phosphoric acid, hydriodic acid, and heterogeneous catalysts such as zeolites, heteropolyacid, amberlyst, and ion exchange resin. Preferred esterification acid catalysts are selected from the group consisting of sulfuric acid, phosphoric acid, hydrochloric acid and hydroiodic acid. A particularly preferred mineral acid catalyst is sulfuric acid.

The amount of catalyst used can be from about 0.01 weight percent to about 10 weight percent of the reaction mixture, preferably from 0.1 weight percent to about 5 weight percent, and more preferably from about 0.2 weight percent to about 2 weight percent, of the reaction mixture.

Any ratio of carboxylic acid, or derivatives thereof, to glycol hydroxyl groups can be used. The preferred ratio of acid to hydroxyl groups is from about 3:1 to about 1:2, where the ratio can be adjusted to shift the ratio of monoester to diester in the product. Generally to favor production of diesters slightly more than a 1:1 ratio is used. To favor production of monoesters, a 0.5:1 ratio or less of acid to hydroxyl is used.

A preferred method for esterification comprises polycondensing 1,3-propanediol reactant to polytrimethylene ether glycol using a mineral acid catalyst, then adding carboxylic acid and carrying out the esterification without isolating and purifying the PO3G. In this method, the etherification or polycondensation of 1,3-propanediol reactant to form polytrimethylene ether glycol is carried out using an acid catalyst as disclosed in U.S. Pat. Nos. 6,977,291 and 6,720,459. The etherification reaction can also be carried out using a polycondensation catalyst that contains both an acid and a base as described in JP2004-182974A. The polycondensation or etherification reaction is continued until desired molecular weight is reached, and then the calculated amount of monocarboxylic acid is added to the reaction mixture. The reaction is continued while the water byproduct is removed. At this stage both esterification and etherification reactions occur simultaneously. Thus, in this preferred esterification method the acid catalyst used for polycondensation of diol is also used for esterification. If necessary additional esterification catalyst can be added at the esterification stage.

In this procedure, the viscosity (molecular weight) of the resulting product is controlled by the point at which the carboxylic acid is added.

In an alternative procedure, the esterification reaction can be carried out on purified PO3G by addition of an esterification catalyst and carboxylic acid followed by heating and removal of water. In this procedure, viscosity of the resulting product is predominantly a function of the molecular weight of the PO3G utilized.

Regardless of which esterification procedure is followed, after the esterification step any by products are removed, and then the catalyst residues remaining from polycondensation and/or esterification are removed in order to obtain an ester product that is stable, particularly at high temperatures. This can be accomplished by hydrolysis of the crude ester product by treatment with water at about 80° C. to about 100° C. for a time sufficient to hydrolyze any residual acid esters derived from the catalyst without impacting significantly the carboxylic acid esters. The time required can vary from about 1 to about 8 hours. If the hydrolysis is carried out under pressure, higher temperatures and correspondingly shorter times are possible. At this point the product can contain diesters, monoesters, or a combination of diesters and monoesters, and small amounts of acid catalyst, unreacted carboxylic acid and diol depending on the reaction conditions. The hydrolyzed polymer is further purified to remove water, acid catalyst and unreacted carboxylic acid by the known conventional techniques such as water washings, base neutralization, filtration and/or distillation. Unreacted diol and acid catalyst can, for example, be removed by washing with deionized water. Unreacted carboxylic acid also can be removed, for example, by washing with deionized water or aqueous base solutions, or by vacuum stripping.

Hydrolysis is generally followed by one or more water washing steps to remove acid catalyst, and drying, preferably under vacuum, to obtain the ester product. The water washing also serves to remove unreacted diol. Any unreacted monocarboxylic acid present can also be removed in the water washing, or can be removed by washing with aqueous base or by vacuum stripping.

If desired, the product can be fractionated further to isolate low molecular weight esters by a fractional distillation under reduced pressure.

Proton NMR and wavelength λ-ray fluorescence spectroscopic methods can be used to identify and quantify any residual catalyst (such as sulfur) present in the polymer. The proton NMR can, for example, identify the sulfate ester groups present in the polymer chain, and wavelength x-ray fluorescence method can determine the total sulfur (inorganic and organic sulfur) present in the polymer. Esters made from the process described above are substantially sulfur free and thus useful for high temperature applications.

Preferably, the PO3G esters after purification have essentially no acid catalyst end groups, but can contain very low levels of unsaturated end groups, predominately allyl end groups, in the range of from about 0.003 to about 0.03 meq/g. Such PO3G ester can be considered to comprise (consist essentially of) the compounds having the following formulae (IV) and (V):

$$R_1—C(O)—O—((CH_2)_3O)_m—R_2 \quad (IV)$$

$$R_1—C(O)—O—((CH_2)_3—O)_mCH_2CH=CH_2 \quad (V)$$

wherein $R_2$ is H or $R_3C(O)$; each of $R_1$ and $R_3$ is individually a substituted or unsubstituted aromatic, saturated aliphatic, unsaturated aliphatic, or cycloaliphatic organic group containing from 6 to 40 carbon atoms; m is in a range such that the Mn is within the range of from about 200 to about 3000 or about 10000; and with compounds of formula (III) being present in an amount such that the allyl end groups (preferably all unsaturation ends or end groups) are present in the range of from about 0.003 to about 0.03 meq/g.

Preferably, the PO3G ester has a viscosity which is less than the viscosity of PO3G (when utilized). Preferred viscosities of PO3G esters range from about 20 cSt to about 150 cSt at 40° C., and more preferably are about 100 cSt or less at 40° C.

Other preferred properties of the PO3G esters can be determined based upon the preferences stated above for PO3G in and of itself. For example, preferred molecular weights and polydispersities are based on the preferred molecular weights and polydispersities of the PO3G component of the ester.

Additives

Synthetic lube oil compositions can contain a mixture of the base stock and one or more additives, where each additive is employed for the purpose of improving the performance and properties of the base stock in its intended application, e.g., as a hydraulic fluid, a gear oil, a brake fluid, a compressor lubricant, a textile and calender lubricant, a metalworking fluid, a refrigeration lubricant, a two-cycle engine lubricant and/or crankcase lubricant.

The additives can generally be added in amounts based on the type of additive and desired level of additive effect, which can generally be determined by those skilled in the relevant art.

Preferably the additives are miscible in either or both of the PO3G and PO3G esters.

Preferably, the lube oil additive(s) comprise at least one of ashless dispersant, metal detergent, viscosity modifier, antiwear agent, antioxidant, friction modifier, pour point depressant, anti-foaming agent, corrosion inhibitor, demulsifier, rust inhibitor and mixtures thereof.

When the lube oil composition is used as a refrigeration lubricant, the lube oil additive(s) preferably comprise at least one of extreme pressure and antiwear additive, oxidation and thermal stability improver, corrosion inhibitor, viscosity index improver, pour point depressant, floc point depressant, detergent, anti-foaming agent, viscosity adjuster and mixtures thereof.

It is intended to be within the scope of the present invention to use any one or more of the specified additives alone or in combination with one or more of the remaining specified additives. It is also within the scope of the present invention to use more than one of any specified additive, e.g., one or more friction modifiers, either alone or in combination of one or more of the other specified additives, e.g., in combination with one or more corrosion inhibitors.

The individual additives can be incorporated into a base stock in any convenient way. Thus, each of the components can be added directly to the base stock by dispersing or dissolving it in the base stock at the desired level of concentration. Such blending can be carried out at ambient temperature or at an elevated temperature.

Alternatively, all or some of the additives can be blended into a concentrate or additive package that is subsequently blended into base stock to make finished lubricant. The concentrate will typically be formulated to contain the additive(s) in proper amounts to provide the desired concentration in the formulation when the concentrate is combined with a predetermined amount of base lubricant.

The ashless dispersant comprises polymeric hydrocarbon backbone having functional groups that are capable of associating with particles to be dispersed. Typically, the dispersants comprise amine, alcohol, amide and/or ester polar moieties attached to the polymer backbone often via a bridging group. The ashless dispersant can be, for example, selected from salts, esters, amino-esters, amides, imides and oxazolines of long chain hydrocarbon substituted mono- and dicarboxylic acids and/or their anhydrides, thiocarboxylate derivatives of long chain hydrocarbons, long chain aliphatic hydrocarbons having a polyamine attached directly thereto, and Mannich condensation products formed by condensing a long chain substituted phenol with formaldehyde and polyalkylene polyamine.

The viscosity modifier (VM) functions to impart high and low temperature operability to a lubricating oil. The VM used can have that sole function, or can be multifunctional.

Multifunctional viscosity modifiers that also function as dispersants are also known. Illustrative viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts can contain a substantially stoichiometric amount of the metal in which they are usually described as normal or neutral salts, and would typically have a total base number (TBN), as can be measured by ASTM D-2896 of from 0 to about 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents can have a TBN of about 150 or greater, and typically from about 250 to about 450 or more.

Illustrative detergents include neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which can both be present in detergents used in a lubricant, and mixtures of calcium and/or magnesium with sodium. Particularly convenient metal detergents are neutral and overbased calcium sulfonates having TBN of from about 20 to about 450, and neutral and overbased calcium phenates and sulfurized phenates having TBN of from about 50 to about 450.

Dihydrocarbyl dithiophosphate metal salts are frequently used as anti-wear and antioxidant agents. The metal can be an alkali or alkaline earth metal, or aluminum, lead, tin, molybdenum, manganese, nickel or copper. The zinc salts are most commonly used in lubricating oil in amounts of from about 0.1 to about 10 weight percent, preferably from about 0.2 to about 2 weight percent, based upon the total weight of the lubricating oil composition. The salts can be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid can be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

In one embodiment, however, the lube oil compositions are preferably substantially zinc free.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil-soluble copper compounds as described in U.S. Pat. No. 4,867,890, and molybdenum containing compounds.

Friction modifiers can be included to improve fuel economy. Oil-soluble alkoxylated mono- and di-amines are well known to improve boundary layer lubrication. The amines can be used as such or in the form of an adduct or reaction product with a boron compound such as boric oxide, boron halide, metaborate, boric acid or a mono-, di- or tri-alkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. An example of another conventional friction modifier is organo-metallic molybdenum.

Illustrative rust inhibitors are selected from the group of nonionic polyoxyalkylene polyols and esters thereof, polyoxyalkylene phenols, and anionic alkyl sulfonic acids.

Copper and lead bearing corrosion inhibitors can also be used. Typically such compounds are the thiadiazole polysulfides containing from 5 to 50 carbon atoms, their derivatives and polymers thereof. Other additives are the thio- and polythio-sulfenamides of thiadiazoles such as those described in UK1560830. Benzotriazole derivatives also fall within this class of additives.

An illustrative example of demulsifying component is described in EP-A-0330522. It is obtained by reacting an alkylene oxide with an adduct obtained by reacting a bis-epoxide with a polyhydric alcohol.

Pour point depressants, otherwise known as lube oil improvers, lower the minimum temperature at which the fluid will flow or can be poured. Such additives are well known. Typical of those additives which improve the low temperature fluidity of the fluid are $C_8$ and $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Some of the above-mentioned additives can provide a multiplicity of effects; thus, for example, a single additive can act as a dispersant-oxidation inhibitor. This approach is well known and does not require further elaboration.

Illustrative, non-limiting examples of additives specific to use in compression refrigeration systems follow.

Illustrative extreme pressure and antiwear additives include phosphates, phosphate esters (bicresyl phosphate), phosphites, thiophosphates (zinc diorganodithiophosphates) chlorinated waxes, sulfurized fats and olefins, organic lead compounds, fatty acids, molybdenum complexes, halogen substituted organosilicon compounds, borates, organic esters, halogen substituted phosphorous compounds, sulfurized Diels Alder adducts, organic sulfides, compounds containing chlorine and sulfur, metal salts of organic acids.

Illustrative oxidation and thermal stability improvers include sterically hindered phenols (BHT), aromatic amines, dithiophosphates, phosphites, sulfides and metal salts of dithio acids.

Illustrative corrosion inhibitors include organic acids, organic amines, organic phosphates, organic alcohols, metal sulfonates and organic phosphites.

Viscosity index is the measure of the change in viscosity with temperature, and a high number suggests that the change in viscosity with temperature is minimal. In view of the relatively high viscosity index of the lube oil compositions disclosed herein, it is possible to formulate a lube oil composition which is free of viscosity index improver. However, there may be applications where it is desirable to further improve viscosity index. Illustrative viscosity index improvers include polyisobutylene, polymethacrylate and polyalkylstyrenes.

Illustrative pour point and or floc point depressants include polymethacrylate ethylene-vinyl acetate copolymers, succinamic acid—olefin copolymers, ethylene alpha olefin copolymers and Friedel-Crafts condensation products of wax with napthalene or phenols.

Illustrative detergents include sulfonates, long-chain alkyl substituted aromatic sulfonic acids, phosphonates, thiophosphonates, phenolates, metal salts of alkyl phenols, alkyl sulfides, alkylphenol-aldehyde condensation products, metal salts of substituted salicylates, N-substituted oligomers or polymers from the reaction products of unsaturated anhydrides and amines and co-polymers which incorporate polyester linkages such as vinyl acetate-maleic anhydride copolymers.

Illustrative Anti-Foaming Agents are Silicone Polymers.

Illustrative viscosity adjusters include polyisobutylene, polymethacrylates, polyalkylstyrenes, naphthenic oils, alkylbenzene oils, paraffinic oils, polyesters, polyvinylchloride and polyphosphates.

In preferred embodiments, the additive(s) are at least partially (greater than about 50% by weight) miscible in the base stock. Generally, this means that the additives used will be oil soluble at least to some extent, and preferably to a substantial extent.

The lube oil composition is preferably a substantially uniform mixture, with substantially no settling or phase separation of components.

The lubrication oil composition preferably comprises the additives in an amount of less than 50 weight percent, based on the total weight of the lubrication oil composition. In various embodiments, the lubrication oil can comprise the additives in an amount of about 25 weight percent or less, or about 10 weight percent or less, or about 5 weight percent or less, based on the total weight of the lubrication oil composition.

The viscosity of the lubrication oil composition preferably ranges from about 20 cSt to about 150 cSt at 40° C., and more preferably is about 30 cSt to about 100 cSt at 40° C. The viscosity of the lubrication oil composition additionally comprising polytrimethylene ether glycol preferably ranges from about 20 cSt to about 500 cSt at 40° C., and more preferably is about 30 cSt to about 300 cSt or less at 40° C.

The four ball wear scar of the lubrication oil composition as measured by ASTMD-4172 is less than 0.67 mm.

The lubrication oil composition has the ability to withstand the extreme pressure (EP) of progressively applied maximum load of 1000 lbs or higher as determined by Falex pin & V block test.

EXAMPLES

All parts, percentages, etc., are by weight unless otherwise indicated.

The number-average molecular weights (Mn) of polyether glycol and polyether glycol ester were determined either by analyzing end-groups using NMR spectroscopic methods or by titration of hydroxyl groups.

ASTM method D445-83 and ASTM method D792-91 were used to determine the kinematic viscosity and density of the polymer, respectively.

Additional ASTM methods were used as listed in the Tables below.

The materials were tested with and without a lube oil additive package. The package used during the testing comprised the components listed in Table 1.

TABLE 1

| Additive | Description | Function | Available From |
|---|---|---|---|
| IRGALUBE ® TPPT | Triphenyl phosphorothionate, typically containing 9% phosphorus and 9.4% sulfur | Anti-wear/ extreme pressure | Ciba Specialty Chemicals, Tarrytown, NY |
| VANLUBE ® 7723 | Methylene bis(dibutyldithiocarbamate) | Ashless antioxidant and extreme pressure | RT Vanderbilt Company Inc Norwalk, CT |
| VANLUBE ® 887E | Tolutriazole | antioxidant | RT Vanderbilt Company Inc Norwalk, CT |
| PANA | Phenyl anaphthalmine | antioxidant | Akrochem, Akron, OH |
| VANLUBE ® RD | Polymerized 1,2-dihydro-2,2,4-trimethylquinoline | antioxidant | R.T. Vanderbilt Co., Inc., Norwalk, CT |
| IRGANOX ® 1135 | Hindered phenol | antioxidant | Ciba Specialty Chemicals, Tarrytown, NY |

TABLE 1-continued

| Additive | Description | Function | Available From |
|---|---|---|---|
| IRGALUBE ® 349 | Mixture of amine phosphates | EP/AW & corrosion inhibitor | Ciba Specialty Chemicals, Tarrytown, NY |
| VANLUBE ® 8912E | Calcium sulfonate | Rust inhibitor | RT Vanderbilt Company Inc Norwalk, CT |
| CUVAN ® 826 | 2,5 dimercapto-1,3,4-thiadiazole derivative | Corrosion inhibitor & metal deactivator | R.T. Vanderbilt Co., Inc., Norwalk, CT |

Preparation of PO3G Homopolymer—PO3G1

A 22-L, 4-necked, round-bottomed flask, equipped with a nitrogen inlet, and a distillation head was charged with 11877 g of 1,3-propanediol. The liquid was sparged with nitrogen at a rate of 10 L/min. and mechanical stirring (using a stirring magnet driven by a magnetic stirrer below the flask) was done for about 15 min. After 15 min., 108 g of sulfuric acid was slowly added drop-wise from a separatory funnel through one of the ports over a period of at least 5 minutes. When this was finished, 15 g of 1,3-propanediol (PDO) was added to the separatory funnel and swirled to remove any residual sulfuric acid. This was added to the flask. The mixture was stirred and sparged as above and heated to 160° C. The water of reaction was removed by distillation and was collected continuously during the polymerization reaction. The reaction was continued for 25 hours, after which it was allowed to cool (while stirring and sparging were maintained) to 45° C.

The crude material was hydrolyzed as follows. The crude polymer was added to a 22-L, 5-necked, round-bottom flask, (equipped with a condenser and a mechanical mixer) along with an equal volume of distilled water. This mixture was stirred mechanically, sparged with nitrogen at a rate of about 150 mL/min. and heated to 100° C. It was allowed to reflux for 4 hours after which the heat was turned off and the mixture allowed to cool to 45° C. The stirring was discontinued and the sparging reduced to a minimum. Phase separation occurred during cooling. The aqueous phase water was removed and discarded. A volume of distilled water equal to the initial amount was added to the wet polymer remaining in the flask. Mixing, sparging and heating to 100° C. was done again for 1 hour after which the heat was turned off and the material allowed to cool as before. The aqueous phase was removed and discarded.

The residual sulphuric acid was determined by titration and neutralized with an excess of calcium hydroxide. The polymer was dried under reduced pressure at 90° C. for 3 hours and then filtered through a Whatman filter paper precoated with a CELPURE C-65 filter aid. The resulting PO3G had a number average molecular weight of 940.

Preparation of Poly(trimethylene-Ethylene Ether) Glycol Copolymer—PO3G2

The above procedure described was repeated except for variation in the amounts of 1,3-propanediol (8811.2 g), 1,2-ethanediol (3080.8 g) and sulfuric acid (108 g) to obtain a poly(trimethylene-ethylene ether) glycol copolymer having a number average molecular weight (Mn) of 890.

Preparation of a 2-Ethylhexanoate PO3G Ester 1,3-propanediol (2.4 kg, 31.5 moles) was charged into a 5 L flask fitted with a stirrer, a condenser and an inlet for nitrogen. The liquid in the flask was flushed with dry nitrogen for 30 minutes at room temperature and then heated to 170° C. while being stirred at 120 rpm. When the temperature reached 170° C., 12.6 g (0.5 weight percent) of concentrated sulfuric acid was added. The reaction was allowed to proceed at 170° C. for 3 hours, and then the temperature was raised to 180° C. and held at 180° C. for 135 minutes. A total of 435 mL of distillate was collected. The reaction mixture was cooled, and then 2.24 kg (14.6 moles) of 2-ethylhexanoic acid (99%) was added. The reaction temperature was then raised to 160° C. under nitrogen flow with continuous agitation at 180 rpm and maintained at that temperature for 6 hours. During this period an additional 305 mL of distillate water was collected. Heating and agitation were stopped and the reaction mixture was allowed to settle. The product was decanted from about 5 g of a lower, immiscible by-product phase. NMR analysis of the by-product phase confirmed that no carboxylic acid esters were present.

2.0 kg of the polytrimethylene ether glycol ester product was mixed with 0.5 kg of water, and then the resulting mixture was heated at 95° C. for 6 hours. The aqueous phase was separated from the polymer phase, and then the polymer phase was washed twice with 2.0 kg of water. The resulting product was heated at 120° C. at 200 mTorr to remove volatiles (255 g). The resulting PO3G ester product has the following properties:

Number average molecular weight (Mn)=500

Viscosity at 40° C. and 100° C. =24 and 5.5 cSt, respectively

Viscosity Index (VI)=180

The resulting PO3G ester was analyzed using proton NMR. No peaks associated with sulfate esters and unreacted 2-ethylhexanoic acid were found. There was no sulfur detected in the polymer when analyzed using WDXRF spectroscopy method.

Example 2

Preparation of PO3G Ester Base Fluid Stock with Additives

A lube oil composition was made from the PO3G ester in Example 1 and the following additives (weight percent based on the total composition weight):

| | |
|---|---|
| PO3G ester | 97.60% |
| TPPT | 0.50% |
| PANA | 0.50% |
| VANLUBE ® RD | 1.00% |
| IRGALUBE ® 349 | 0.30% |
| CUVAN ® 826 | 0.10% |

Table 2 lists the properties of the base oil and lube oil compositions.

TABLE 2

| Property | Test Method | Neat PO3G ester (Comparative) | Example 2 |
|---|---|---|---|
| Pour point, ° C. | ASTM D-97 | −60 | −63 |
| Flash point, ° C. | ASTM D-92 | 238 | 242 |
| Four ball wear scar, mm | ASTM D-4172 | 0.67 | 0.45 |
| Load wear Index | ASTM D-2783 | 21.5 | 23 |
| Last nonseizure load (scar) | | 50 kg (0.36 mm) | 40 kg (0.32 mm) |
| Weld load | | 126 kg | 200 kg |
| Falex Pin & V block test Max Load, lbs | ASTM D-3233 | 1000 | 3000 |

This example shows that the PO3G ester in the absence of additives (neat) performs poorly as a lube oil in terms of wear and load characteristics. In the presence of additives, the performance improves significantly. For example the lubrication composition of the Comparative Example (neat PO3G ester) was not able to withstand the extreme pressure (EP) of progressively applied maximum load of 1000 lbs whereas the lubrication composition of Example 2 was able to withstand the maximum load up to 3000 lbs as determined by Falex pin & V block test. Also, the four ball wear scar of the composition decreased from 0.67 mm to 0.45 mm.

Example 3

PO3G1 (75 weight percent based on the weight of the base fluid stock) and the PO3G ester (25 weight percent based on the weight of the base fluid stock) prepared above were mixed and a lube oil composition was prepared by adding the following additives (weight percent below based on the total composition weight):

| | |
|---|---|
| Blend of base fluids | 97.60% |
| TPPT | 0.50% |
| PANA | 0.50% |
| VANLUBE ® RD | 1.00% |
| IRGALUBE ® 349 | 0.30% |
| CUVAN ® 826 | 0.10% |

Example 4

PO3G2 (75 weight percent based on the weight of the base fluid stock) and the PO3G ester of Example 1 (25 weight percent based on the weight of the base fluid stock) prepared above were mixed and a lube oil composition was prepared by adding the following additives (weight percent based on total composition weight).

| | |
|---|---|
| Blend of base fluid | 97.60% |
| IRGALUBE ® TPPT | 0.50% |
| PANA | 0.50% |
| VANLUBE ® RD | 1.00% |
| IRGALUBE ® 349 | 0.30% |
| CUVAN ® 826 | 0.10% |

Table 3 lists the lube properties of the blend fluid.

Example 5

PO3G2 (25 weight percent based on the weight of the base fluid stock) and the PO3G ester (75 weight percent based on the weight of the base fluid stock) prepared above were mixed and a lube oil composition was prepared by adding the following additives (weight percent based on total composition weight).

| | |
|---|---|
| Blend of base fluid | 97.60% |
| IRGALUBE ® TPPT | 0.50% |
| PANA | 0.50% |
| VANLUBE ® RD | 1.00% |
| IRGALUBE ® 349 | 0.30% |
| CUVAN ® 826 | 0.10% |

Table 3 lists the lube properties of the blend fluid.

TABLE 3

| Property | Test Method | Example 4 | Example 5 |
|---|---|---|---|
| Four ball wear scar, mm | ASTM D-4172 | 0.40 | 0.63 |
| Load wear Index | ASTM | 33.6 | 27.2 |
| Last nonseizure load (scar) | D-2783 | 63 kg (0.36 mm) | 50 kg (0.33 mm) |
| Last seizure load (scar) | | 160 kg (2.69 mm) | 160 kg (2.68 mm) |
| Weld load | | 200 kg | 200 kg |
| Falex Pin & V block test Max Load, lbs | ASTM D-3233 | 4500 | 4500 |

Example 4 and 5, show that the blends mixed with the same additives as in Example 2, surprisingly show properties that are improved over the unblended PO3G ester, that vary depending on the ratio of the blend. The lubrication compositions of Example 4 and 5 are shown to withstand the extreme pressure (EP) of progressively applied maximum load of 4500 lbs whereas the lubrication composition of Example 2 was only able to withstand the maximum load up to 3000 lbs.

Example 6

PO3G1 (25 weight percent based on the weight of the base fluid stock) and the PO3G ester (75 weight percent based on the weight of the base fluid stock) prepared above were mixed and a lube composition was prepared as follows (weight percent below based on the total composition weight):

| | |
|---|---|
| Blend of base fluids | 97.3% |
| IRGALUBE ® TPPT | 0.40% |
| VANLUBE ® 7723 | 0.30% |
| VANLUBE ® 887E | 0.20% |
| PANA | 0.40% |
| VANLUBE ® RD | 0.80% |
| IRGALUBE ® 349 | 0.40% |
| CUVAN ® 826 | 0.10% |

Table 4 lists the lube properties of the blend fluid.

TABLE 4

| Property | ASTM Method | Example 6 |
|---|---|---|
| Viscosity @ 40° C., cSt | D445 | 38.5 |
| Viscosity Index | | 182 |
| Pour point, ° C. | D97 | 0 |
| Flash Point, ° C. | D-92 | 240 |
| Evaporation | D-972 | 0.42% |
| Foaming sequence 1,2,3 | D-892 | None |
| Copper corrosion | D-130 | 1 b |
| Four Ball Wear Scar, mm | D-4172 | 0.69 |
| Load Wear Index | D-2783 | 24.5 |
| Last nonseizure load,(scar, mm) | D-2783 | 40 kg (.31) |
| Last seizure load (scar, mm) | | 160 kg (2.59) |
| Weld Load, kg | | 200 |
| Falex Pin & V block Max load, lbs | D3233 | 3400 |

Example 7

A lube oil composition was prepared by adding the following additive package to a poly(trimethylene-ethylene ether) glycol (Mn=1100, PO3G3) to form an initial composition.

| | |
|---|---|
| PO3G3 | 97.85% |
| Defoamer DC 200 cSt | 0.0025% |
| VANLUBE ® 7723 | 0.3% |
| VANLUBE ® 887E | 0.4% |
| IRGANOX ® 1135 | 0.2% |
| IRGALUBE ® TPPT | 0.5% |
| IRGALUBE ® 349 | 0.4% |
| VANLUBE ® RD | 0.25% |
| CUVAN ® 826 | 0.1% |

This lube oil composition (90 weight percent based on total weight) was blended with the 2-Ethylhexanoate PO3G Ester (10 weight percent based on total weight) prepared as described above.

Table 5 lists the lube properties of the finished product which is suitable, for example, as a rotating machinery lubricant (gears, bearings) and as a hydraulic fluid.

TABLE 5

| Property | ASTM Method | Example 7 |
|---|---|---|
| Viscosity @ 40° C., cSt | | 236 |
| Viscosity Index | | 206 |
| Pour point, ° C. | D97 | −45 |
| Flash Point, ° C. | D-92 | 288 |
| Four Ball Wear Scar, mm | D-4172 | 0.37 |
| Coefficient of friction | D-4172 | 0.033 |
| Load Wear Index | D-2783 | 61.5 |
| Last nonseizure load,(scar, mm) | D-2783 | 160 kg (.52) |
| Weld Load, kg | | 200 |
| Falex Pin & V block Max load, lbs | D3233 | 3000 |
| Oxidation Test Data | D4636 | |
| Viscosity change, % | 24 hrs @ 190° C. | 1.49 |
| Acid number change (mg/KOH/g) | | 0.07 |
| % Evaporation loss, | | 0.65 |
| Sediment weight, mg | | 4.4 |
| Copper corrosion | D-4646 | Dull-ib |

What is claimed is:

1. A lubrication oil composition comprising (i) a base fluid stock comprising a mixture of poly(trimethylene ether) glycol (PO3G) that is a fluid at ambient temperature, and a carboxylic acid ester of a polytrimethylene ether glycol (PO3G ester) that is a fluid at ambient temperature; and (ii) one or more lube oil additives, wherein the mixture of PO3G and PO3G ester comprise at least 95 weight percent based on the weight of the lubrication oil composition, wherein the PO3G is prepared by the polycondensation of monomers comprising 1,3-propanediol in the presence of a sulfur-based acid catalyst, and wherein each of the PO3G and the PO3G ester are present at 25 weight percent or more based on the weight of the base fluid stock.

2. The lubrication oil composition of claim 1, wherein the acid ester of the polytrimethylene ether glycol comprises from about 50 to 100 weight percent diester and from 0 to about 50 weight percent monoester, based on the weight of the acid ester.

3. The lubrication oil composition of claim 1, wherein said lube oil additive comprises at least one of ashless dispersant, metal detergent, viscosity modifier, anti-wear agent, antioxidant, friction modifier, pour point depressant, anti-foaming agent, corrosion inhibitor, demulsifier or rust inhibitor.

4. The lubrication oil composition of claim 1, wherein said lube oil additive is at least 50% miscible in the base fluid.

5. The lubrication oil composition of claim 1, wherein said lube oil composition is a substantially uniform mixture, with substantially no settling or phase separation, of the components.

6. The lubrication oil composition of claim 1, wherein the acid ester of the polytrimethylene ether glycol is an acid ester of a monocarboxylic acid and/or equivalent.

7. The lubrication oil composition of claim 1, wherein the acid ester has a number average molecular weight based on a polytrimethylene ether glycol having a number average molecular weight of at least about 250 to less than about 3000.

8. The lubrication oil composition of claim 1, wherein the acid ester is prepared from biologically produced 1,3-propanediol.

9. The lubrication oil composition of claim 1, wherein the base stock has a viscosity of from about 20 cSt to about 150 cSt at 40° C.

10. The lubrication oil composition of claim 1 wherein the four ball wear scar as measured by ASTMD-4172 is less than 0.67 mm.

11. The lubrication oil composition of claim 1, wherein the acid ester of polytrimethylene ether glycol is substantially sulfur free and substantially free of acid catalyst end groups.

12. The lubrication oil composition of claim 1, wherein the base fluid stock consists essentially of the mixture of the polytrimethylene ether glycol and the acid ester of the polytrimethylene ether glycol.

13. The lubrication oil composition of claim 12, wherein the weight ratio of the acid ester of the polytrimethylene ether glycol to the polytrimethylene ether glycol in the base fluid stock is 1:1 or greater.

14. The lubrication oil composition of claim 12, wherein from 99% to 100% of repeating units in the polytrimethylene ether glycol are trimethylene ether units.

15. The lubrication oil composition of claim 12, wherein the acid ester of the polytrimethylene ether glycol has a viscosity that is less than the viscosity of the polytrimethylene ether glycol.

16. The lubrication oil composition of claim 12, wherein the base stock fluid has a viscosity of from about 20 cSt to about 300 cSt at 40° C.

* * * * *